US008747176B2

(12) United States Patent
Lynch et al.

(10) Patent No.: US 8,747,176 B2
(45) Date of Patent: Jun. 10, 2014

(54) METHOD OF FORMING A SPARK PLUG

(71) Applicant: Fram Group IP LLC, Lake Forest, IL (US)

(72) Inventors: Michael S. Lynch, Fostoria, OH (US); Steven M. Brickner, Bascom, OH (US)

(73) Assignee: Fram Group IP LLC, Lake Forest, IL (US)

( * ) Notice: Subject to any disclaimer, the term of this patent is extended or adjusted under 35 U.S.C. 154(b) by 0 days.

(21) Appl. No.: 13/746,819

(22) Filed: Jan. 22, 2013

(65) Prior Publication Data

US 2013/0196563 A1 Aug. 1, 2013

Related U.S. Application Data

(60) Provisional application No. 61/591,492, filed on Jan. 27, 2012.

(51) Int. Cl.
*H01T 21/02* (2006.01)

(52) U.S. Cl.
USPC ..... 445/7; 313/118; 313/120; 123/169 EL

(58) Field of Classification Search
USPC ..... 313/118–145; 123/169 R, 169 EL, 32, 123/41, 3, 10; 445/7
See application file for complete search history.

(56) References Cited

U.S. PATENT DOCUMENTS

| | | | | |
|---|---|---|---|---|
| 2,296,033 | A | 9/1942 | Heller | |
| 2,503,194 | A | 4/1950 | Cipriani et al. | |
| 4,643,688 | A | 2/1987 | Byerly et al. | |
| 4,786,267 | A | 11/1988 | Toya et al. | |
| 5,159,233 | A * | 10/1992 | Sponseller et al. | 313/141 |
| 7,059,926 | B2 * | 6/2006 | McMurray et al. | 445/7 |

OTHER PUBLICATIONS

Int'l Search Report and Written Opinion of PCT/US2013/022528 dated Mar. 22, 2013.

* cited by examiner

*Primary Examiner* — Tracie Y Green
(74) *Attorney, Agent, or Firm* — Erin J. Fox; Barnes & Thornburg LLP

(57) ABSTRACT

A method for forming a spark plug includes positioning an electrode center wire within an insulator and positioning at least one substance within the insulator and proximate the electrode center wire. The method further includes ultrasonically tamping the at least one substance to the electrode center wire.

24 Claims, 5 Drawing Sheets

METHOD OF FORMING A SPARK PLUG

CROSS-REFERENCE

This application claims the benefit of U.S. Provisional Patent Application No. 61/591,492, filed Jan. 27, 2012 and entitled "Method of Forming a Spark Plug," the entire disclosure of which is incorporated herein.

BACKGROUND

The subject matter disclosed herein relates to spark plugs, and more particularly to a method for forming spark plugs.

Typically, when forming spark plugs, a center electrode assembly is mounted within a center bore of an insulator, such that a center electrode tip projects from a tip of the insulator. A spark gap is formed between the center electrode tip and a ground electrode that typically extends from a shell surrounding the insulator. Such spark plugs are often formed by filling the center bore of the insulator with glass powder, or other substances that are configured in close proximity to the center electrode assembly. After the center bore is filled, the substances are tamped to a certain density by using a tamper machine or hand tamping the spark plug. Such a process, however, may be cumbersome to set up and poses challenges for producing an insulator core assembly with precision.

Accordingly, while existing methods of fabricating a spark plug are suitable for their intended purpose, the need for improvement remains, particularly in the fabrication of the insulator core assembly.

SUMMARY

According to one embodiment, a method for forming a spark plug includes positioning an electrode center wire within a center bore of an insulator and positioning at least one substance within the center bore of the insulator proximate the electrode center wire. The method also includes ultrasonically tamping the insulator so that the at least one substance is ultrasonically tamped to the electrode center wire.

According to another embodiment, a method for forming a spark plug includes positioning an insulator around a portion of a center wire. The method further includes introducing a sealing substance within the insulator proximate to the center wire. The method yet further includes ultrasonically tamping the sealing substance to the center wire.

According to yet another embodiment, a method for forming a spark plug includes surrounding at least part of an electrode center wire with an insulator. The method also includes inserting at least one substance within the insulator proximate the electrode center wire. The method further includes ultrasonically tamping the at least one substance to the electrode center wire.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
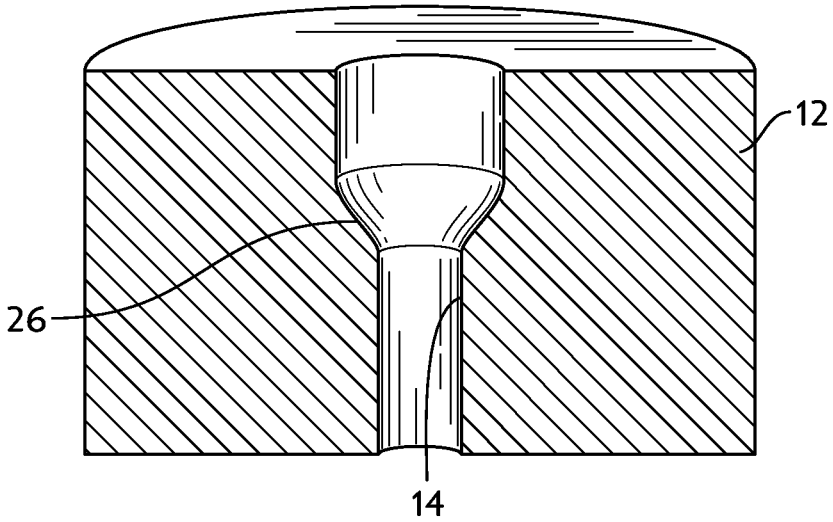
FIG. 1 is a cross-sectional view of a shell or mold for holding portions of a spark plug when performing an ultrasonic tamping process.

The detailed description explains embodiments of the invention, together with advantages and features, by way of example with reference to the drawings.

DETAILED DESCRIPTION

A method of forming a spark plug in accordance with the present disclosure includes the steps of positioning an electrode center wire 20 within an insulator 16 of the spark plug, filling the insulator 16 with a substance 30 proximate to the electrode center wire 20, and applying an ultrasonic tamping process to at least a portion of the spark plug in order to ultrasonically tamp the substance 30 to the electrode center wire 20. The spark plug generally includes the insulator 16, electrode center wire 20, and a metal casing with a ground electrode. While the insulator 16 and electrode center wire 20 are shown in the diagrams, the metal casing and ground electrode have been omitted because the method herein occurs before assembly of the insulator 16 and electrode center wire 20 with the metal casing. In illustrative embodiments, the substance 30 and the electrode center wire 20 are positioned within a center bore 18 of the insulator 16, and the insulator 16 is subjected to an ultrasonic tamping process within a shell 12 that is configured to hold the insulator 16. Other methods of ultrasonic tamping the substance 30 to the electrode center wire 20 are also envisioned.

Figure 2:
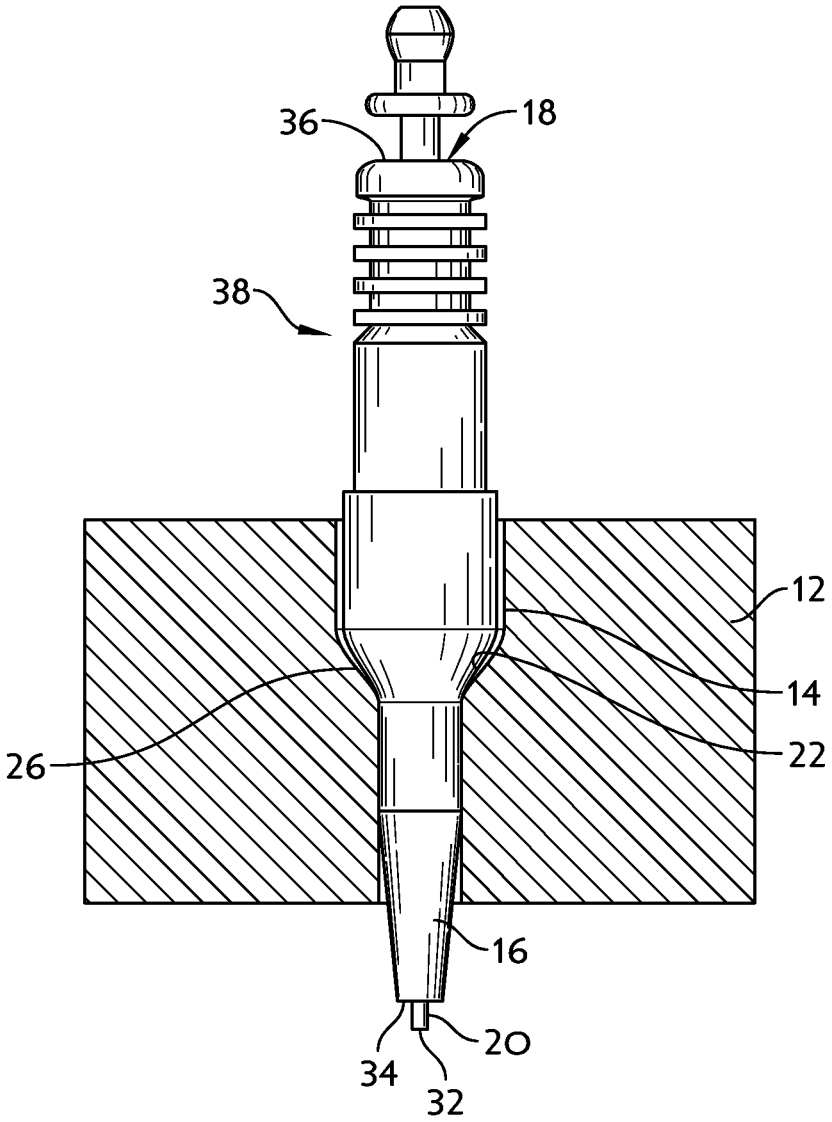
FIG. 2 is a partial cross-sectional view of depicting the shell of FIG. 1 in cross-section and showing portions of a spark plug positioned within a center bore of the shell, wherein the portions of the spark plug include an insulator and a center electrode extending through the insulator.

Referring now to FIG. 1, in an illustrative embodiment, a shell 12 includes a counter-bored portion 14 that is configured to seat the insulator 16 of the spark plug. The counter-bored portion 14 may be configured to extend through the center of shell 12. As seen in FIG. 2, the insulator 16 includes a shoulder 22 that is positioned to contact a ledge 26 of the counter-bored portion 14 of the shell 12 for seating therein. In an illustrative embodiment, the shell 12 may include a circular outer periphery to facilitate use of the shell 12 in the ultrasonic tamping process. In other illustrative embodiments, the shell 12 may have an outer periphery that has any other suitable shape.

The shell 12 may be manufactured in a variety of shapes and with various known substances that can absorb shock from the insulator 16 during the ultrasonic process. For instance, the shell 12 can comprise a mold of a nylon, aluminum, steel, plastic or composite material, as illustrated in FIG. 1. The shell 12 could also be the metal casing (not shown) to that is used to complete the formation of the spark plug. Other embodiments of the shell 12 are also envisioned and within the scope of this disclosure.

Figure 3:
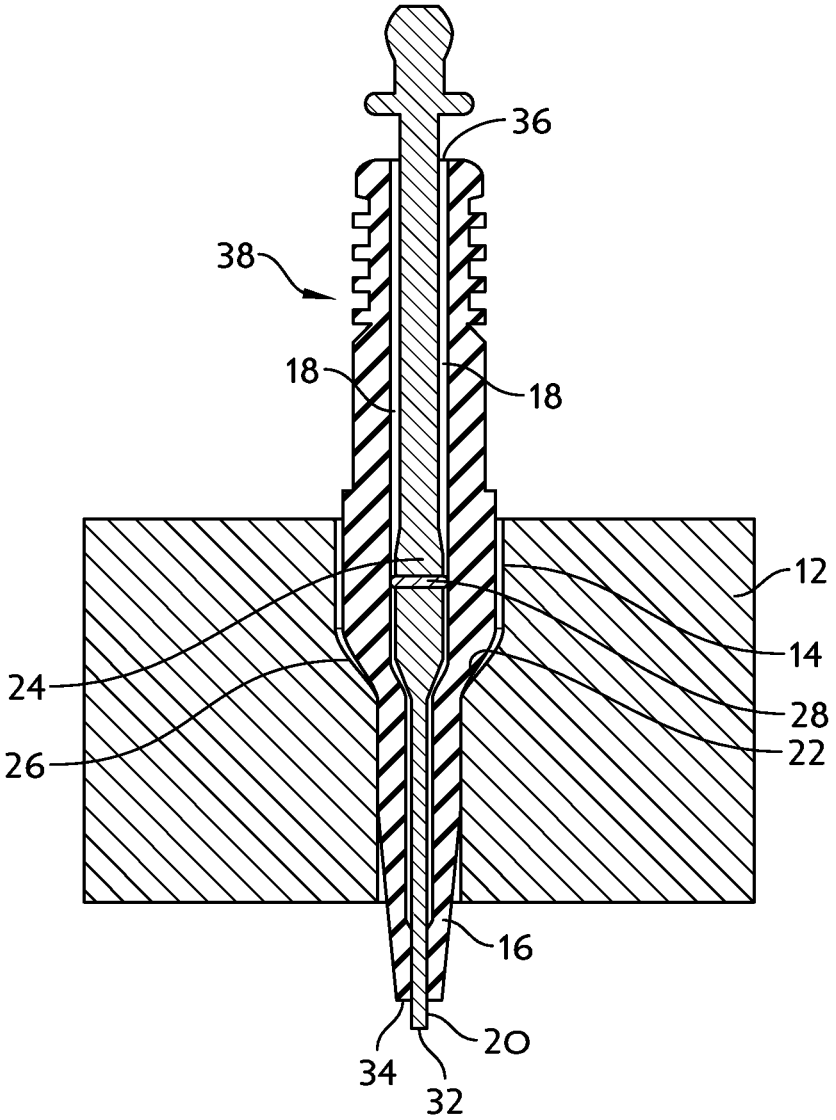
FIG. 3 is a cross-sectional view similar to the view of FIG. 2 and showing the portions of the spark plug in cross-section and further showing the center electrode positioned within a center bore of the insulator.

As illustrated in FIGS. 2 and 3, the center bore 18 of the insulator 16 may be configured to extend a length of the insulator 16 and is configured for positioning the electrode center wire 20 therein. Additionally, the center bore 18 of the insulator 16 is configured to receive various substances 30 that serve various purposes for operation of the spark plug, as can be seen in and will be discussed in greater detail with respect to FIG. 4. Such substances 30 may include sealing powder, resistor substance, electrically conductive or semi-conductive substances, and/or other suitable substances, and combinations thereof.

Figure 4:
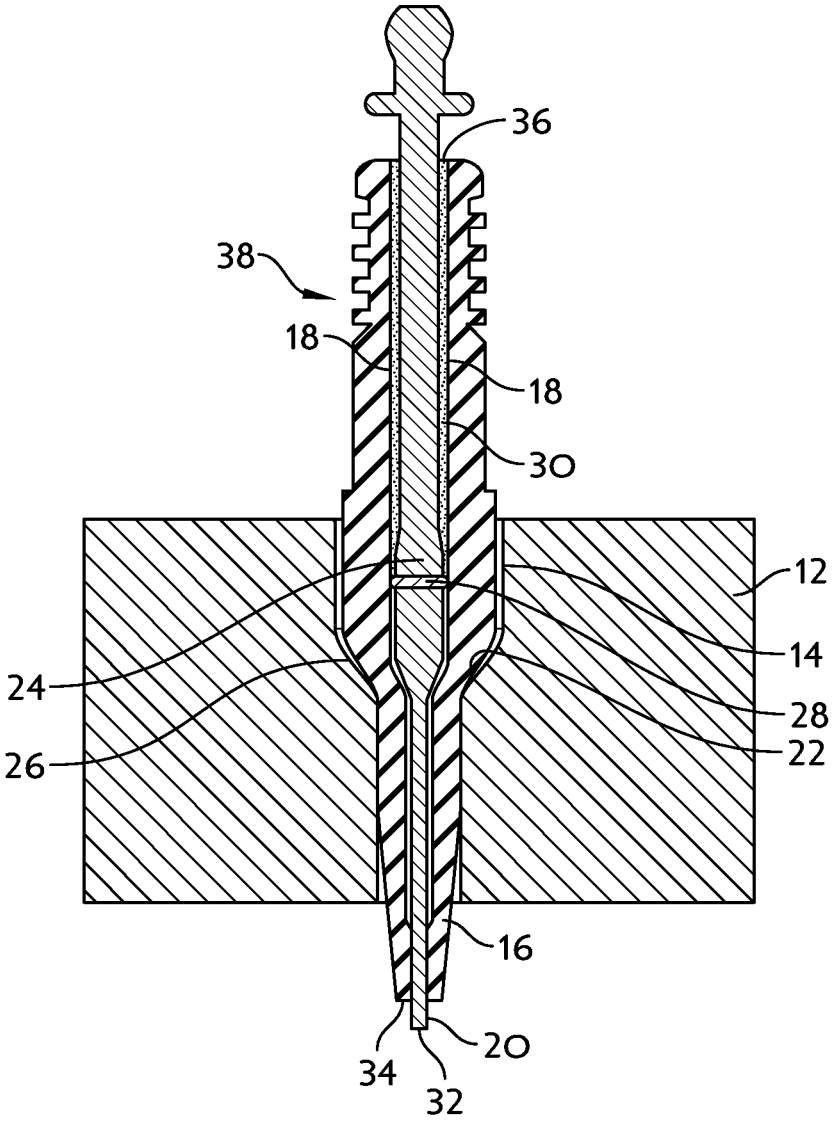
FIG. 4 is a cross-sectional view similar to FIG. 3 and showing at least one substance filing the center bore of the insulator proximate the center electrode.

Referring now to FIGS. 2-4, during assembly of the spark plug, the insulator 16 is positioned within the shell 12 by sliding the insulator 16 into a seated position of the counter-bored portion 14 of the shell 12. Such positioning and/or seating may be facilitated by press-fitting the insulator 16 into the shell 12 until the shoulder bottom 22 of the insulator 16 contacts the ledge 26 of the counter-bored portion 14 of the shell 12. The electrode center wire 20 may be inserted within the center bore 18 of the insulator 16 before or after the insulator 16 is positioned within the shell 12. As illustrated in FIGS. 3 and 4, the electrode center wire 20 includes a shoulder stop 24 and is pushed down into the center bore 18 of the insulator 16 until contacting a spacer 28 within the center bore 18 of the insulator 16. The electrode center wire 20 is configured to be seated within the insulator 16 such that a tip 32 of the electrode center wire 20 extends outside of a tip 34 of the insulator 16, thus facilitating operation of the spark plug.

As discussed previously and shown in FIG. 4, the center bore 18 is configured to receive various substances 30 in addition to the electrode center wire 20. The substances 30 include, but not limited to sealing powder, resistor substance, electrically conductive or semi-conductive substances, and/or other suitable substances, and combinations thereof. The substances 30 may be introduced into the center bore 18 of the insulator 16 after the electrode center wire 20 is seated within the insulator 16. The substances 30 may be introduced via an opening 36 at the top of the center bore 18 and configured to be proximate to, and typically above, the shoulder stop 24 of the electrode center wire 20, as illustrated in FIG. 4. The substance 30 may encase electrode center wire 20 near the shoulder stop 24. The substance 30 can extend up through the center bore 18 a variety of lengths based on the particular substances 30 used, including but not limited to approximately 0.425 inches.

Various properties may be obtained by the introduction of such substances 30 into the insulator 16 of the spark plug. For example, a powdered sealing material that is present proximate the electrode center wire 20 and the insulator 16 functions to retain the electrode center wire 20 in a stable position with respect to the insulator 16 and form a seal between the electrode center wire 20 and the insulator 16. Additionally, an electrically conductive or semi-conductive powder within the center bore 18 of the insulator 16 also retains the electrode center wire 20 in a stable position, forms a seal, and maintains electrical continuity in the electrode center wire 20. Such electrically conductive or semi-conductive powder and may also function as an ignition noise suppressor. These are merely representative functions and properties that may be attained by the introduction of such substances 30 into the insulator 16 of the spark plug.

Figure 5:
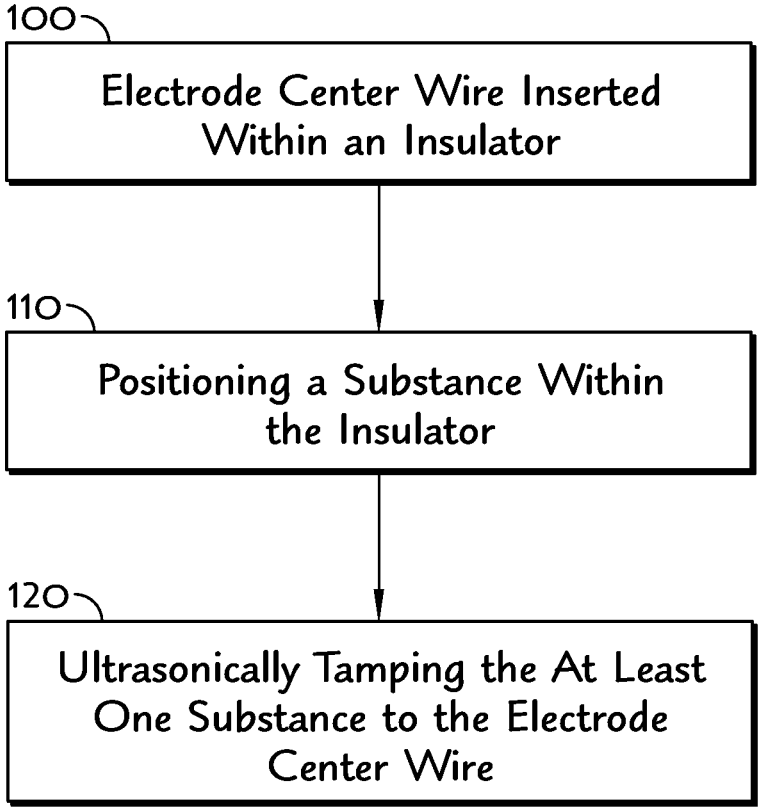
FIG. 5 is a flow diagram illustrating a method of forming portions of a spark plug.

In accordance with the present disclosure, a portion of the spark plug as illustrated in FIG. 4 is configured to be subjected to an ultrasonic tamping process. Such process may occur when the insulator 16 of the spark plug is located within shell 12, wherein the shell 12 facilitates the process and protects the portion of the spark plug from unintended effects of the ultrasonic process. Specifically, upon positioning of the shell 12, the insulator 16, the electrode center wire 20, and the various substances 30, as described above, the entire assembly (and thereby each of the components) is subjected to an ultrasonic blast that compacts the components and overall assembly. As illustrated in FIG. 5, the first step 100 of the assembly process includes inserting the electrode center wire 20 into the insulator 16 prior to the substances 30. The second step 110 includes positioning the substances 30 within the insulator 16 adjacent the electrode center wire 20. The final step 120 includes subjecting the insulator 16, electrode center wire 20, and the substances 30 to ultrasonic tamping. Among other things, the ultrasonic compaction of the substances 30 to the electrode center wire 20 can form a seal between the electrode center wire 20 and the insulator 16, thereby retaining the electrode center wire 20 within the center bore 18 of the insulator 16.

Such ultrasonic compaction may be controlled and varied as needed by an operator. For example, various densities of the various substances 30 may be produced by manipulation of the ultrasonic tamping process parameters. Manipulation of the parameters to produce various desired densities and properties may be achieved by controlling the ultrasonic frequency, pressure, duration time, and other conceivable parameters of the ultrasonic blast. Such ultrasonic manipulation provides manufacturing flexibility and reliability and simplifies the spark plug manufacturing process by alleviating the need for performing several tamps, by hand or machine, to attain the desired properties of the spark plug.

As disclosed above, manipulation of the parameters is conducted to best suit various applications. One such parameter combination is a pressure of 30 psi, time duration of 0.2 seconds, and a frequency of 20 kiloHertz (kHz). These parameters may be modified, but irrespective of the parameter combination, the method provides a user the ability to perform the method in a small number of sonic blasts, rather than the more tedious process of multiple tamping efforts commonly used to assemble spark plug components.

The ultrasonic process of the present disclosure may be performed via typical ultrasonic procedures known in the industry, and may be performed by a standard ultrasonic tamping apparatus or machine. Such ultrasonic processes typically comprise sandwiching the components between a fixed shaped nest (anvil) and a sonotrode (horn) connected to a transducer, then emitting a 20 kHz low-amplitude acoustic vibration. Although a frequency of 20 kHz has been described as an example, it is conceivable that other common frequencies may include, but is not limited to, 15 kHz, 30 kHz, 35 kHz, 40 kHz and 70 kHz.

When the ultrasonic process occurs, the substances 30 are configured to melt or otherwise become sealingly engaged with the components adjacent to the substances 30, thereby sealing the insulator 16 and the electrode center wire 20. More generally, the concentrated ultrasonic energy melts the point contact between the components, creating a joint. In this way, the electrode center wire 20 is retained in the insulator 16 and maintains electrical continuity.

In addition to retaining the electrode center wire 20 within the insulator 16, a seal between the electrode center wire 20 and the insulator 16 also ensures that the tip 32 of the electrode center wire 20 is maintained at a fixed position with respect to the tip 34 of the insulator 16. In illustrative embodiments (not shown in the Figures), after the ultrasonic tamping has occurred, the insulator 16, the electrode center wire 20, and the substances 30 form an insulator core assembly 38. The insulator core assembly 38 is configured to be surrounded by a metal casing (not shown) to form the spark plug. The metal casing typically includes a ground electrode (not shown) that extends from the casing adjacent to the tip 32 of the electrode center wire 20. A spark gap (not shown) may be formed between the tip 32 and the ground electrode. Maintaining the tip 32 of the electrode center wire 20 in a fixed position also facilitates maintenance of the ground electrode at a fixed distance across the spark gap.

The order of the assembly steps disclosed above may be performed in numerous orders other than that which was described above and should not be seen as limited to such an order. As one example of such a reordering of steps, the electrode center wire 20 may be inserted within the insulator 16 prior to the introduction of the insulator 16 to the shell 12. Insertion of the insulator 16 into the shell 12 provides stable retainment of the insulator 16 and the electrode center wire 20 while the ultrasonic manipulation or tamping occurs.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A method for forming a spark plug comprising:

positioning an electrode center wire within an insulator;

positioning at least one substance within the insulator and proximate the electrode center wire; and ultrasonically tamping the at least one substance to the electrode center wire.

2. The method for forming a spark plug of claim 1, wherein the at least one substance is a sealing substance.

3. The method for forming a spark plug of claim 2, wherein the at least one substance further comprises a resistor substance.

4. The method for forming a spark plug of claim 1, further comprising the step of positioning the insulator proximate a shell.

5. The method of claim 4, wherein the shell retains the insulator during the step of ultrasonically tamping the at least one substance to the electrode center wire.

6. The method for forming a spark plug of claim 1, wherein the step of ultrasonically tamping further comprises the step of running an ultrasonic machine at a frequency of approximately 20 kilohertz (kHz).

7. The method for forming a spark plug of claim 1, wherein the step of ultrasonically tamping further comprises the step of applying a pressure of approximately 30 psi.

8. The method for forming a spark plug of claim 1, wherein the step of ultrasonically tamping further comprises the step of applying the ultrasonic tamp for an application time of approximately 0.2 seconds.

9. The method for forming a spark plug of claim 1, further comprising the step of positioning the insulator around a portion of the electrode center wire and introducing the at least one substance within the insulator prior to the step of ultrasonically tamping.

10. A method for forming a spark plug comprising:

positioning an insulator around a portion of an electrode center wire;

introducing a sealing substance within the insulator to create an assembly; and applying an ultrasonic blast to the assembly to compact the sealing substance to the electrode center wire to retain the center wire within the insulator.

11. The method for forming a spark plug of claim 10, further comprising the step of introducing a resistor substance within the insulator.

12. The method for forming a spark plug of claim 10, further comprising the step of positioning the insulator proximate a shell.

13. The method of claim 12, wherein the shell retains the insulator during the step of ultrasonically tamping the sealing substance to the electrode center wire for sealing the electrode center wire.

14. The method for forming a spark plug of claim 10, wherein the step of ultrasonically tamping further comprises the step of running an ultrasonic machine at a frequency of approximately 20 kilohertz (kHz).

15. The method for forming a spark plug of claim 10, wherein the step of ultrasonically tamping further comprises the step of applying a pressure of approximately 30 psi.

16. The method for forming a spark plug of claim 10, wherein the step of ultrasonically tamping further comprises the step of applying the ultrasonic tamp for an application time of approximately 0.2 seconds.

17. A method for forming a spark plug comprising:

surrounding at least part of an electrode center wire with an insulator;

inserting at least one substance within the insulator proximate the electrode center wire to create an assembly; and an ultrasonic blast to the assembly to compact the at least one substance to the electrode center wire to retain the center wire within the insulator.

18. The method for forming a spark plug of claim 17, wherein the at least one substance is a sealing substance.

19. The method for forming a spark plug of claim 18, wherein the at least one substance further comprises a resistor substance.

20. The method for forming a spark plug of claim 17, further comprising the step of positioning the insulator proximate a shell.

21. The method of claim 20, wherein the shell retains the insulator during the step of ultrasonically tamping the at least one substance to the electrode center wire.

22. The method of claim 21, wherein the shell is configured to be used with or seated in a standard ultrasonic machine.

23. The method for forming a spark plug of claim 17, wherein the step of ultrasonically tamping further comprises the step of running an ultrasonic machine at a frequency of approximately 20 kilohertz (kHz).

24. The method for forming a spark plug of claim 17, wherein the step of ultrasonically tamping further comprises the step of applying a pressure of approximately 30 psi.

* * * * *